US005417555A

United States Patent [19]

Kuban et al.

[11] Patent Number: 5,417,555

[45] Date of Patent: May 23, 1995

[54] ROTARY VANE MACHINE HAVING END SEAL PLATES

[75] Inventors: William G. Kuban, Columbia Heights; Ingo E. Wolfe, Brooklyn Park; David J. Luoma, Andover, all of Minn.

[73] Assignee: Kurt Manufacturing Company, Inc., Fridley, Minn.

[21] Appl. No.: 196,987

[22] Filed: Feb. 15, 1994

[51] Int. Cl.[6] ..... F01C 19/08

[52] U.S. Cl. ..... 418/131; 418/264

[58] Field of Search ..... 418/131, 132, 134, 135, 418/264

[56] References Cited

U.S. PATENT DOCUMENTS

| | | | |
|---|---|---|---|
| 1,492,456 | 4/1924 | Ellehammer . | |
| 1,996,875 | 4/1935 | McCann | 418/131 |
| 2,636,480 | 4/1953 | Becker . | |
| 3,193,190 | 7/1965 | Lindberg | 418/131 |
| 3,578,889 | 5/1971 | Dagne et al. . | |
| 3,988,083 | 10/1976 | Shimizu et al. | 418/264 |
| 5,087,183 | 2/1982 | Edwards | 418/265 |
| 5,160,252 | 11/1992 | Edwards | 418/1 |

FOREIGN PATENT DOCUMENTS

| | | | |
|---|---|---|---|
| 0003493 | 1/1985 | Japan | 418/131 |

*Primary Examiner*—Richard A. Bertsch
*Assistant Examiner*—Charles G. Freay
*Attorney, Agent, or Firm*—Westman, Champlin & Kelly

[57] ABSTRACT

A rotary vane machine includes a rotor having one or more sliding vanes. The rotor rotates within a chamber of a housing. At least one sealing plate is located between an end surface of the rotor and a corresponding inner surface of the housing. The sealing plate improves the seal between the rotor surface and the inner housing surface.

7 Claims, 6 Drawing Sheets

PRIOR ART

ROTARY VANE MACHINE HAVING END SEAL PLATES

BACKGROUND OF THE INVENTION

The present invention relates to a rotary vane machine having a rotor with sliding vanes that are guided for non-contact sealing movement between the vane tips and an interior casing sidewall. In particular, the present invention relates to sealing plates positioned on both ends of the rotor to improve sealing of the rotor with interior casing end walls.

Rotary vane machines are known and have been described for example in U.S. Pat. Nos. 5,087,183 and 5,160,252. The rotary vane machines described in these references includes a cylindrical rotor equipped with one or more tethered sliding vanes wherein the rotor is positioned eccentrically inside a housing. The housing defines an enclosed chamber with opposed end surfaces. As the rotor rotates about its axis, fluid received from an inlet is compressed and discharged out an outlet.

Although the rotary vane machine provides an efficient pump to suit many applications, components of the rotary vane machine must be manufactured with extreme precision in order for the machine to operate effectively. Particularly, the rotor must be positioned within the chamber of the housing with end surfaces close to, but not contacting, inner end surfaces of the housing. If manufactured correctly, the rotor will not contact the inner end surfaces of the housing, but rather, will allow oil to be located therebetween to provide a continuous annular seal for the chamber as the rotor rotates. Typically, bearing assemblies are provided in annular recesses formed in the opposed end surfaces. The bearing assemblies allow rotation of the tether assemblies about the rotor axis. In order to extend the annular sealing surfaces of the housing opposing the end surfaces of the rotor, outer races of the bearing assemblies must be machined after the bearing assemblies have been installed to provide a smooth inner annular surface opposing each of the rotor end surfaces. This method of manufacture is both difficult and time consuming, thus increasing the cost of the machine.

SUMMARY OF THE INVENTION

The present invention relates to an improved rotary vane machine. The rotary vane machine includes a rotor positioned eccentrically within a chamber of a housing. The rotor includes vanes which are guided in close proximity to inner surfaces of the housing. The rotary vane machine receives fluid through an inlet and compresses the fluid in the chamber before discharging the compressed fluid through a discharge outlet.

Sealing plates are provided between the rotor end surfaces and opposed end surfaces of the housing. The sealing plates fill the space between these opposed surfaces in order to improve the seal between the rotor and the housing as the rotor rotates.

Bearing assemblies are provided in annular recesses of the housing. The bearing assemblies allow rotational movement of vane tether assemblies used to control movement of the vanes within the rotor. In a preferred embodiment, the bearing assemblies are recessed below the annular end surfaces of the housing with the sealing plates extending from the outer perimeter of the inner chamber toward the rotor axis. The sealing plates extend over the recesses and a portion of the bearing assemblies to provide a uniform seal for the chamber on each end surface of the rotor.

The rotary vane machine of the present invention is both more efficient and easier to manufacture than rotary valve vane machines of the prior art. The sealing plates disposed between the end surfaces of the rotor and the inner surfaces of the housing reduce friction and provide a better seal between the rotor end surfaces and the housing. The rotary vane machine of the present invention is also easier to manufacture since grinding of the bearing flange or race is not necessary.

In addition, the sealing plates can be manufactured in various thicknesses. In this manner, a sealing plate with the appropriate thickness to substantially fill the gap between the rotor end surface and the inner surface of the housing can be used, thereby providing the best possible seal in spite of machining differences from part to part. The sealing plates can be formed from any suitable material that is machinable and can operate in the chamber of the housing. One type of material is springsteel. With suitable sealing or lubricating oil located on each side of the sealing plates, specifically, between the sealing plates and the rotor end surfaces, and between the sealing plates and the housing inner surfaces, the sealing plates provide an improved seals with almost zero leakage.

DETAILED DESCRIPTION OF THE PREFERRED EMBODIMENTS

The elements illustrated in the accompanying Figures are not drawn to scale, but rather, have been exaggerated to highlight the important features of the subject matter therein.

Figure 1:
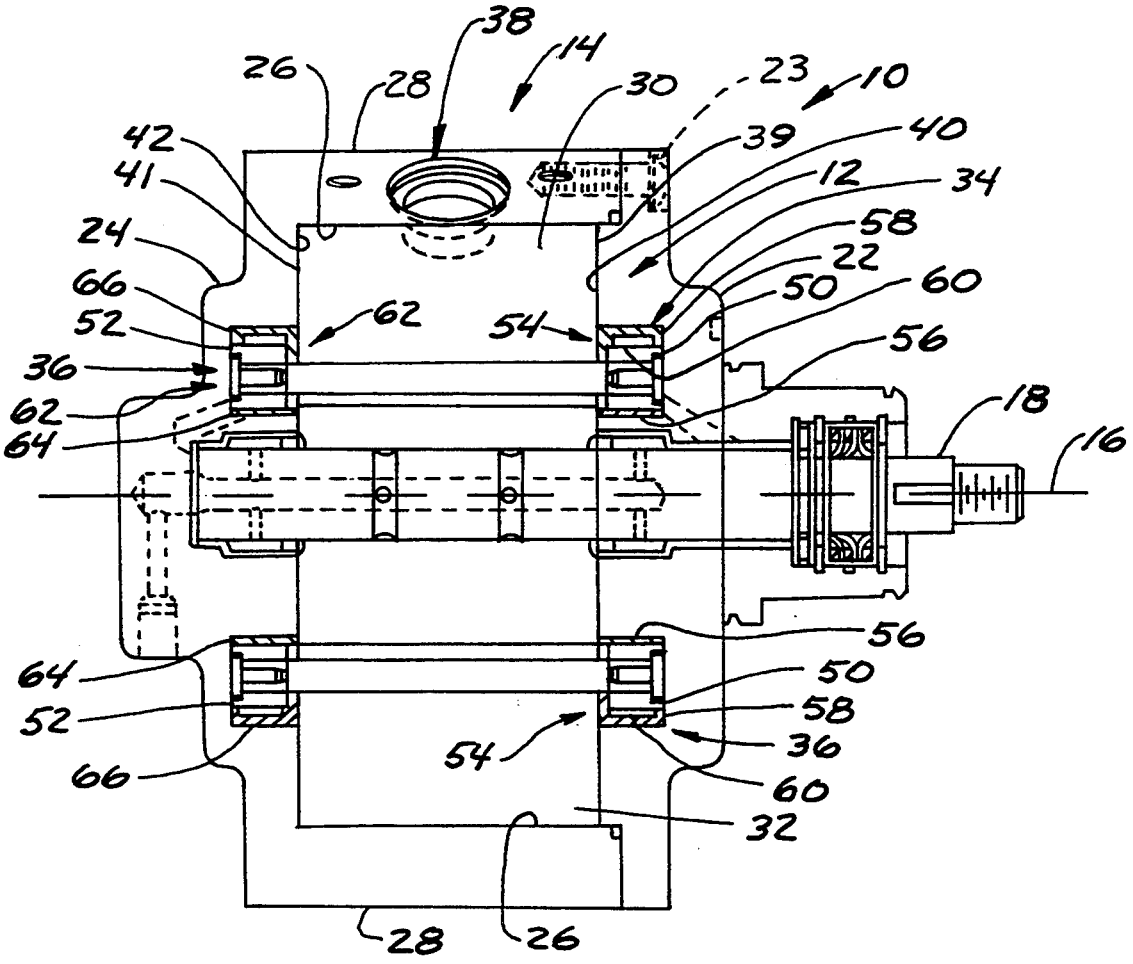
FIG. 1 is an elevational view with parts in section of a rotary vane machine of the prior art.
Figure 2:
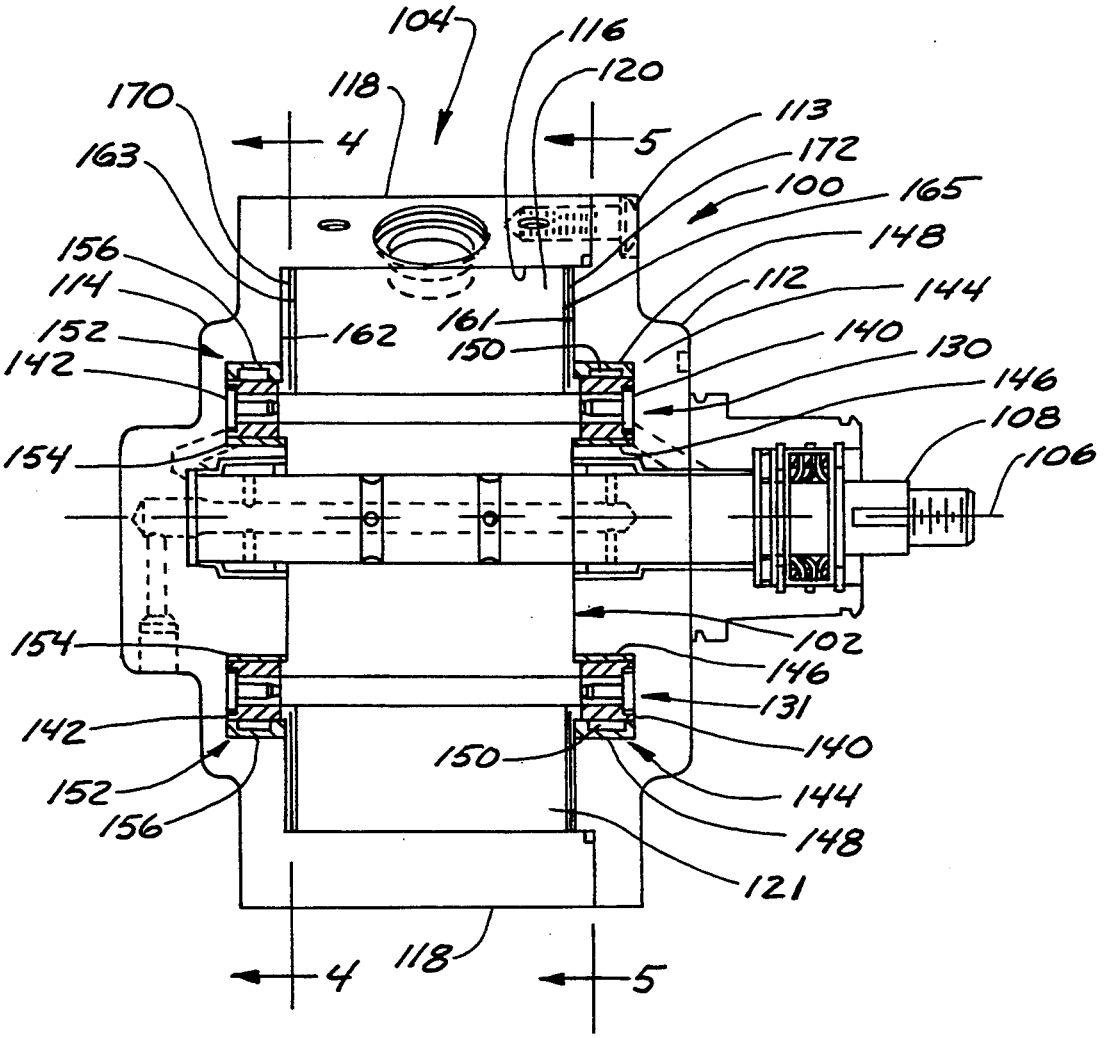
FIG. 2 is an elevational view with parts in section of a rotary vane machine of the present invention.

Referring now to FIG. 1, a rotary vane machine 10 of the prior art is illustrated. Generally, the rotary vane machine 10 includes a rotor 12 positioned eccentrically in a casing illustrated generally at 14 with the rotor rotating about an axis indicated at 16. The rotor 12 includes a rotor shaft 18 rotatably supported in endcap 22 and a stator housing 24. The stator housing 24 includes an extending sidewall 28 that with the endcap 22 forms an inner chamber 26. The endcap 22 is fastened to the extending sidewall 28 with a plurality of fasteners, one of which is illustrated at 23.

The rotor 12 further includes vanes illustrated at 30 and 32. The vanes 30 and 32 are joined to the rotor 12 with tethering assemblies indicated at 34 and 36, respectively. The tethering assemblies 34 and 36 guide the vanes 30 and 32 respectively, maintaining tips of the vanes 30 and 32 in close but contactless relation to the interior surfaces of the sidewall 28. As described in detail in U.S. Pat. Nos. 5,087,183 and 5,160,252, which are hereby incorporated by reference, volumetric changes are made as the rotor 12 rotates about the axis 16.

End surfaces 39 and 41 of the rotor 12 are also positioned in non-contacting relationship to annular end surfaces 40 and 42 of the endcap 22 and the stator housing 24, respectively. The rotary vane machine 10 compresses fluid entering through an inlet 38 with compressed fluid exiting a discharge outlet, not shown.

FIG. 1 further illustrates that the endcap 22 includes an annulus 50, while the stator housing 24 includes an annulus 52. A bearing assembly 54 is located in the annulus 50 and includes an inner race 56 and an outer race 58. Suitable needle bearings 60 are provided to allow rotation of the tether assemblies 34 and 36 within the bearing assembly 54. A similar bearing assembly 62 is provided in the annulus 52 and includes an inner race 64 and an outer race 66. Various bearing assemblies are illustrated in U.S. Pat. Nos. 5,087,183 and 5,160,252, and are hereby incorporated by reference.

As stated above and further explained in U.S. Pat. Nos. 5,087,183 and 5,160,252, the vanes 30 and 32 are held in contactless relation to the inner surfaces of the casing 14 during rotation of the rotor 12. However, in order to compress the fluid within the chamber 26, the vanes 30 and 32 must be very close to the interior surfaces of sidewall 28, while the rotor end surfaces 39 and 41 must be very close to the annular surfaces 40 and 42. If excessive space exists between the annular surfaces 40 and 42 and the end surfaces 39 and 41 of the rotor 12, efficiency of the rotary vane machine 10 is decreased due to leakage of the fluid past the vane tips and into the space between the rotor end surfaces 39 and 41 and the annular end surfaces 40 and 42.

In order to maintain substantially zero clearance between the annular surfaces 40 and 42 and the opposed surfaces of the rotor 12, precise machining is necessary when mounting the rotor 12 within the chamber 28. In particular, the endcap 22 and the stator housing 24 must be joined together to provide substantially zero clearance between the annular surfaces 40 and 42 and the end surfaces 39 and 41 of the rotor 12. As described above, the bearing assemblies 54 and 62 are located in the annuli 50 and 52. Since the races 58 and 66 also oppose the end surfaces 39 and 41 of the rotor 12, these surfaces must be machined after installation of the bearing assemblies 54 and 62 in order to provide a substantially co-planer surface with the annular surfaces 40 and 42.

FIGS. 2–5 illustrate the improved rotary vane machine of the present invention at 100. The rotary vane machine 100 includes a rotor 102 disposed in a casing illustrated generally at 104. The rotor 102 includes a rotor shaft 108 which is supported in an endcap 112 and a stator housing 114 and rotates about an axis 106. The stator housing 114 includes an extending sidewall 118 that with the endcap 112 forms an inner chamber 116. The endcap 112 is fastened to the extending sidewall 118 with a plurality of fasteners, one of which is illustrated at 113.

Figure 5:
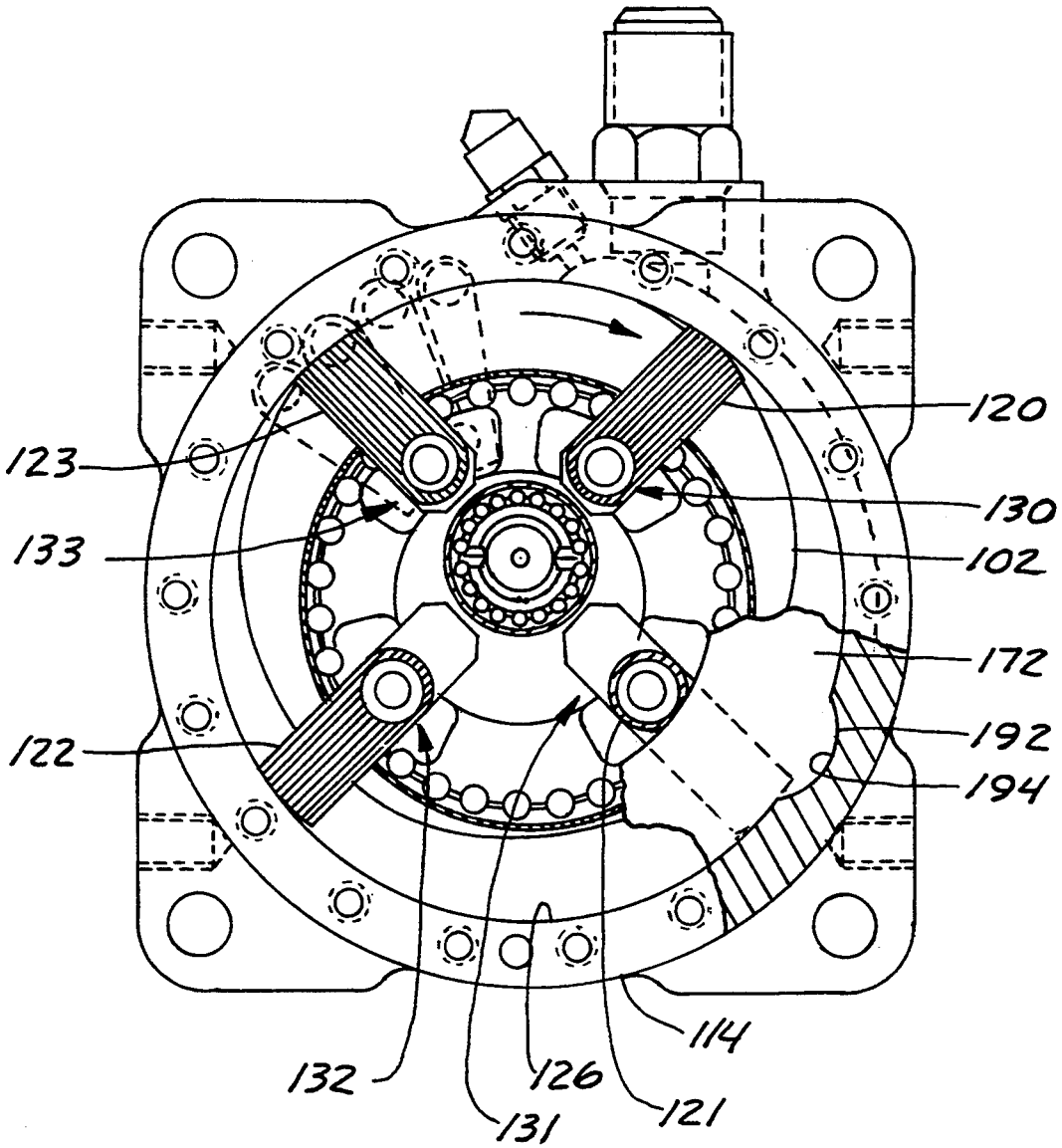
FIG. 5 is an end view of the rotary vane machine taken along lines 5—5 and with parts broken away and parts in section.

The rotor 102 further includes vanes illustrated at 120, 121, 122, and 123 in FIG. 5. The vanes 120–123 are joined to the rotor 102 with tethering assemblies indicated at 130, 131, 132, and 133 respectively. The tethering assemblies 130–133 guide the vanes 120–123 respectively, maintaining tips of the vanes 120–123 in close but contactless relation to the interior surfaces of the sidewall 118. Construction of the rotor 102 and the tethering assemblies 130–133 is described in detail in U.S. Pat. Nos. 5,087,713 and 5,160,252, which are hereby incorporated by reference.

Figure 3:
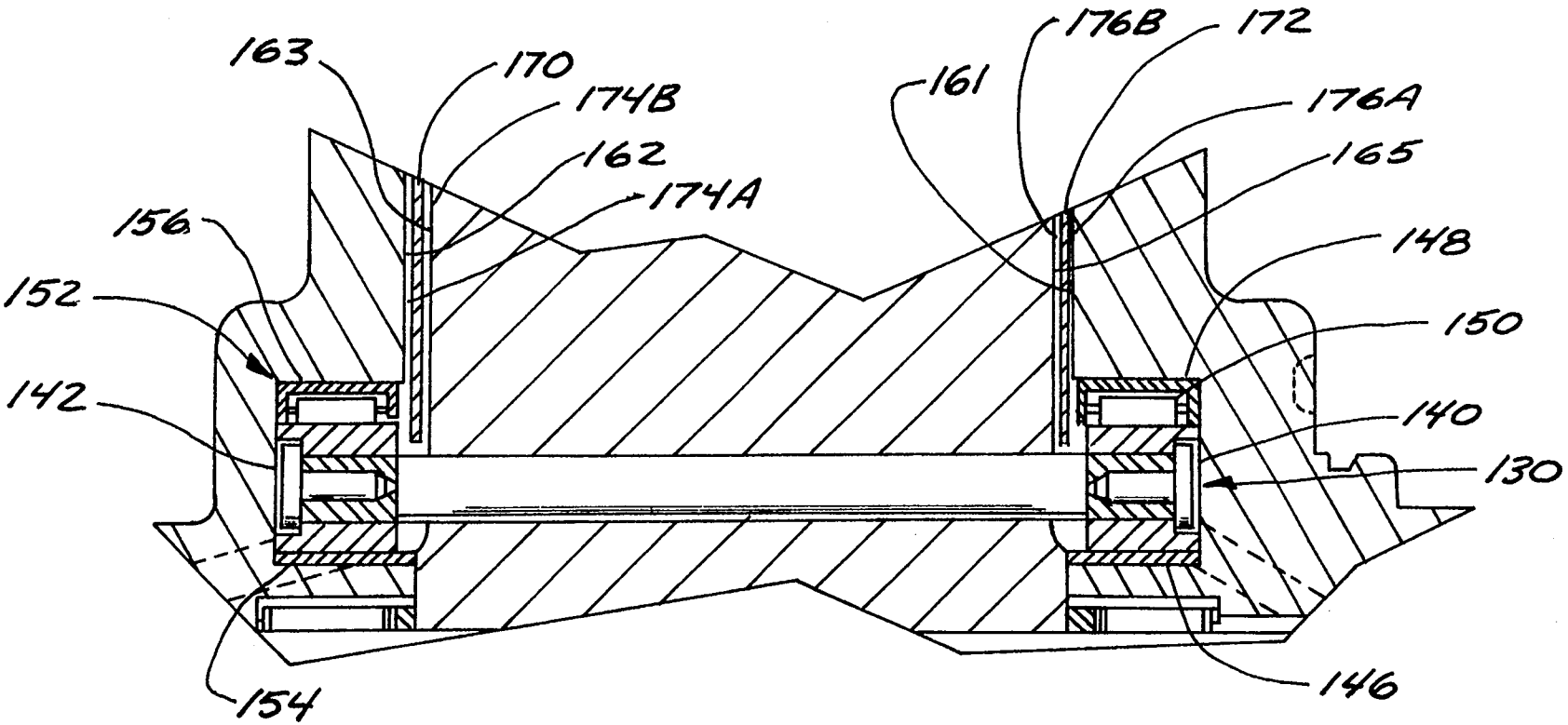
FIG. 3 is an enlarged sectional view of FIG. 2.

Referring back to FIG. 2 and also to FIG. 3, the endcap 112 includes an annulus 140, while the stator housing 114 includes an annulus 142. A bearing assembly 144 is located in the annulus 140 and includes an inner race 146 and an outer race 148. Suitable needle bearings 150 are provided to allow rotation of the tether assemblies 120–123 within the bearing assembly 144. A similar bearing assembly 152 is provided in the annulus 142 and includes an inner race 154 and an outer race 156. It should be noted that unlike the rotary vane machine 10 described above, the outer races 148 and 156 are recessed within each corresponding annulus 140 and 142. In other words, the bearing assemblies 144 and 150 are recessed within the endcap 112 and the stator housing 114, respectively, and do not extend past annular surfaces 161 and 162 of the endcap 112 and the stator housing 114, respectively.

Figure 4:
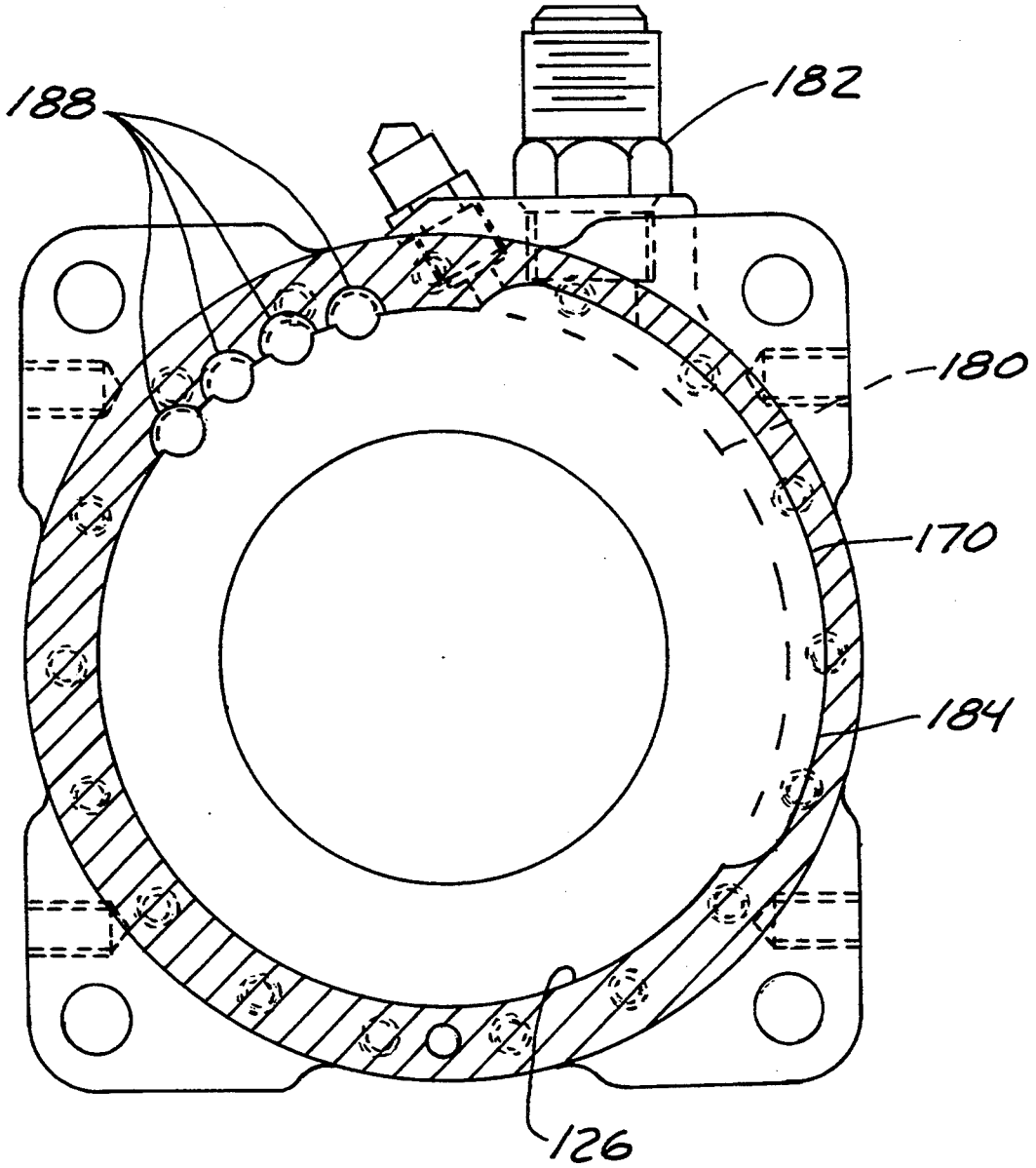
FIG. 4 is a sectional view of the rotary vane machine taken along lines 4—4 in FIG. 2.
Figure 6:
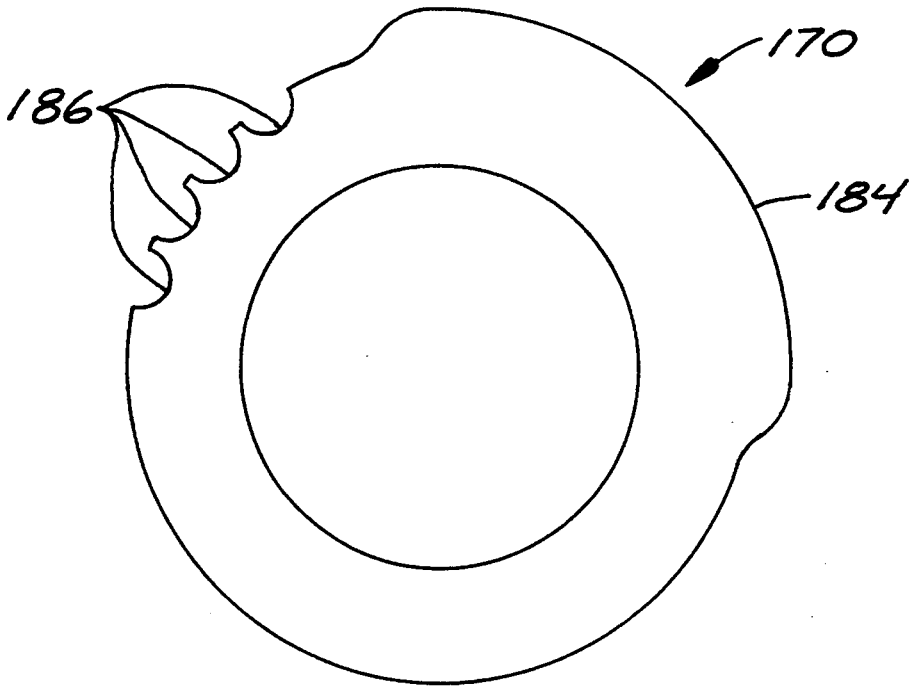
FIG. 6 is an elevational view of a first sealing plate.
Figure 7:
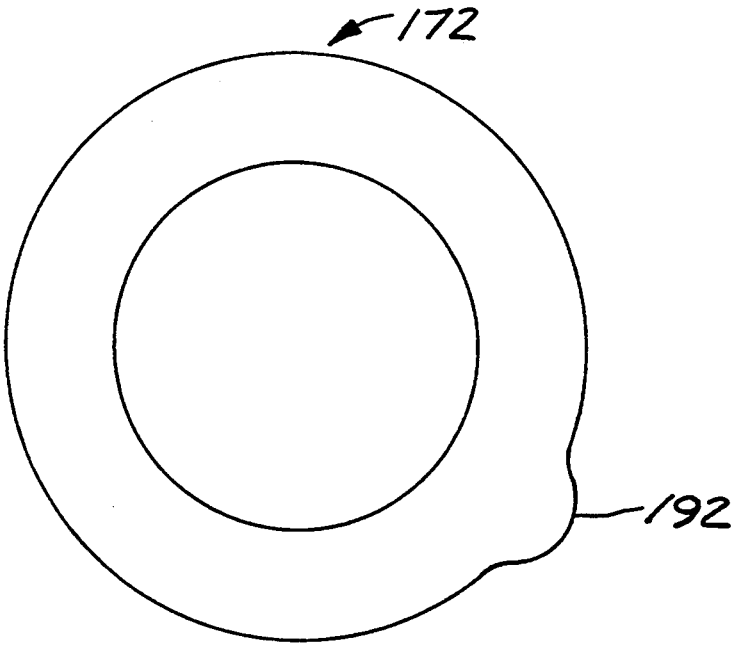
FIG. 7 is an elevational view of a second sealing plate.

To improve sealing between the rotor 102 and the endcap 112 and the rotor 102 and the stator housing 114, sealing plates 170 and 172 are provided. The sealing plate 170 is located between the annular surface 162 and an opposed rotor surface 163 and extends annularly about the axis 106 within the chamber 126, as illustrated in FIG. 4. The sealing plate 172 is located between the annular surface 161 and an opposed rotor surface 165 and also extends about the axis 106 within the chamber 126, a portion of which is illustrated in FIG. 5. An elevational view of the sealing plate 170 is provided in FIG. 6, while an elevational view of the sealing plate 172 is provided in FIG. 7.

Referring back to FIG. 3, the sealing plate 170 substantially fills the space between the annular surfaces 162 and the opposed rotor surfaces 163 leaving a small gap 174A between the sealing plate 170 and the annular surface 162 and a small gap 174B between the sealing plate 170 and the rotor surface 163. Similarly, the sealing plate 172 substantially fills the space between the annular surfaces 163 and the opposed rotor surfaces 165 leaving a small gap 176A between the sealing plate 172 and the annular surface 163 and a small gap 176B between the sealing plate 172 and the rotor surface 165. In operation, a suitable lubricant fills the gaps 174A, 174B, 176A and 176B to provide an excellent seal for the chamber 126 without contact particularly between the rotor surfaces 163 and 165 and the sealing plates 170 and 172.

Preferably, as illustrated in FIGS. 4 and 5, the sealing plates 170 and 172 are provided with extending portions that operate as stops to prevent rotation of the sealing plates 170 and 172 with the rotor 102. Referring to FIG. 4, the stator housing 114 includes an intake channel 180 that fluidly connects an intake fitting 182 with the chamber 126. An extending portion or boss 184 generally conforms to and protrudes into the intake channel 180. A plurality of recesses 186 are provided and correspond generally to outlet ports 188 that are fluidly connected to a discharge fitting, not shown. Similarly, the sealing plate 172 illustrated in FIG. 5 and 7 includes an extending portion or boss 192 that generally conforms to and protrudes into a recess 194 formed in the stator housing 114.

Although the present invention has been described with reference to preferred embodiments, workers skilled in the art will recognize that changes may be made in form and detail without departing from the spirit and scope of the invention.

What is claimed is:

1. A rotary vane machine comprising:

a housing having two opposed end surfaces defining a chamber wherein at least one end surface has an annular recess opening to the opposed end surface;

a rotor assembly supported by the end surfaces and mounted for rotation within the chamber of the housing, the rotor assembly having end surfaces facing the end surfaces of the housing, a moveable vane, and a bearing assembly connected to the moveable vane, the bearing assembly being disposed in the annular recess so that the bearing assembly does not extend beyond an annular surface of the end surface of the housing adjacent the annular recess;

a sealing plate disposed between one of the rotor assembly end surfaces and the annular surface where a first gap is formed between the sealing plate and the rotor assembly end surface and a second gap is formed between the sealing plate and the annular surface, and wherein the sealing plate extends over the annular recess and the bearing assembly; and a sealing fluid disposed in the first gap and the second gap.

2. The machine of claim 1 and further comprising means for preventing rotational movement of the sealing plate.

3. The machine of claim 2 wherein the means for preventing rotational movement comprises a portion of the sealing plate extending into a recess provided in the housing.

4. A rotary vane machine comprising:

a housing having a first housing end surface and a second housing end surface, the first and second housing end surfaces defining a chamber, and wherein the first housing end surface has a first annular recess opening to the second housing end surface, and the second housing end surface has a second annular recess opening to the first housing end surface;

a rotor assembly supported by the first and second housing end surfaces and mounted for rotation within the chamber of the housing, the rotor assembly having a first rotor end surface facing the first housing end surface and a second rotor end surface facing the second housing end surface, a moveable vane, and a first and second bearing assembly connected to the moveable vane, the first bearing assembly being disposed in the first annular recess so that the first bearing assembly does not extend beyond a first annular surface of the first housing end surface adjacent the first annular recess, and the second bearing assembly being disposed in the second annular recess so that the second bearing assembly does not extend beyond a second annular surface of the second housing end surface adjacent the second annular recess;

a first sealing plate disposed between the first rotor assembly end surface and the first annular surface where a first gap is formed between the first sealing plate and the first rotor end surface and a second gap is formed between the first sealing plate and the first annular surface, and wherein the first sealing plate extends over the first annular recess and the first bearing assembly;

a second sealing plate disposed between the second rotor assembly end surface and the second annular surface where a third gap is formed between the second sealing plate and the second rotor end surface and a fourth gap is formed between the second sealing plate and the second annular surface, and wherein the second sealing plate extends over the second annular recess and the second bearing assembly; and a sealing fluid disposed in the first, second, third and fourth gaps.

5. The machine of claim 4 and further comprising means for preventing rotational movement of the sealing plates.

6. The machine of claim 5 wherein the means for preventing rotational movement comprises a portion of each sealing plate extending into a corresponding recess provided in the housing.

7. A rotary vane machine comprising:

a housing enclosing having two opposed end surfaces defining a chamber;

a rotor assembly supported by said end surfaces and mounted for rotation within the chamber of the housing, the rotor assembly having end surfaces facing the end surfaces of the housing, and a moveable vane;

a sealing plate disposed between one of the rotor surfaces and the corresponding opposed housing end surface, and wherein a portion of the sealing plate extends into a recess provided in the housing to prevent rotation of the sealing plate.

* * * * *